US008492963B2

(12) United States Patent
Ma

(10) Patent No.: US 8,492,963 B2
(45) Date of Patent: Jul. 23, 2013

(54) SPARK PLUG WITH VOLUME-STABLE ELECTRODE MATERIAL

(75) Inventor: Shuwei Ma, Ann Arbor, MI (US)

(73) Assignee: Federal-Mogul Ignition Company, Southfield, MI (US)

( * ) Notice: Subject to any disclaimer, the term of this patent is extended or adjusted under 35 U.S.C. 154(b) by 79 days.

(21) Appl. No.: 12/954,061

(22) Filed: Nov. 24, 2010

(65) Prior Publication Data

US 2011/0121712 A1 May 26, 2011

Related U.S. Application Data

(60) Provisional application No. 61/264,111, filed on Nov. 24, 2009.

(51) Int. Cl.
*H01T 13/20* (2006.01)

(52) U.S. Cl.
USPC ..... 313/141; 313/140; 313/118

(58) Field of Classification Search
USPC ..... 313/118–145
See application file for complete search history.

(56) References Cited

U.S. PATENT DOCUMENTS

| | | | | |
|---|---|---|---|---|
| 3,754,902 | A | 8/1973 | Boone et al. | |
| 3,832,167 | A | 8/1974 | Ker Shaw et al. | |
| 4,312,682 | A | 1/1982 | Herchenroeder | |
| 4,460,542 | A | 7/1984 | Herchenroeder | |
| 5,472,663 | A | 12/1995 | Kitamura et al. | |
| 5,477,022 | A * | 12/1995 | Friese | 219/121.61 |
| 2003/0038575 | A1 | 2/2003 | Hori et al. | |
| 2003/0062815 | A1 | 4/2003 | Kanao et al. | |
| 2003/0155849 | A1 * | 8/2003 | Hori | 313/141 |
| 2004/0080252 | A1 * | 4/2004 | Ito et al. | 313/141 |
| 2009/0189502 | A1 * | 7/2009 | Suzuki et al. | 313/141 |

OTHER PUBLICATIONS

International Search Report for PCT/US2010/058028, Aug. 31, 2011, 3 pages.

J.R. Davis, "Nickel, Cobalt, and Their Alloys", ASM Specialty Handbook, ASM International, Materials Park, OH (pp. 167-172).

EP Extended Search Report for PCT/US2010/058028, Apr. 24, 2013, 9 pages.

A. Sajjadi and S.M. Zebarjad; Effect of Temperature on Tensile Fracture Mechanisms of a Ni-based Superalloy; Archives of Materials Science and Engineering; vol. 28, No. 1; pp. 34-40; Jan. 1, 2007.

NN; Superalloy; Wikipedia, Internet site: URL:http://web.archive.org/web/20090601235941/http://en.wikipedia.org/wiki/Superalloy [retrieved Apr. 16, 2013]; 6 pages; Jun. 1, 2009.

* cited by examiner

*Primary Examiner* — Joseph L Williams
(74) *Attorney, Agent, or Firm* — Reising Ethington P.C.

(57) ABSTRACT

A spark plug having one or more electrodes at least partially fabricated from an aluminum-containing Ni-based alloy. The alloy is a volume-stable alloy that includes a $Ni_3Al$ precipitate in a γ'-phase distributed in a Ni matrix γ-phase. The precipitate is formed in the alloy prior to the alloy being used to fabricate electrodes and thus prevents additional $Ni_3Al$ precipitate from being formed in the alloy once in service in a high-temperature environment. This, in turn, prevents a volume decrease of the alloy that may lead to an increased spark gap and spark plug malfunction. The volume-stable alloy may be made by solution treatment, quenching, and heat aging of a Ni—Cr—Al—Fe alloy.

18 Claims, 2 Drawing Sheets

SPARK PLUG WITH VOLUME-STABLE ELECTRODE MATERIAL

CROSS-REFERENCE TO RELATED APPLICATION

This application claims the benefit of U.S. Provisional Application No. 61/264,111 filed on Nov. 24, 2009, the entire contents of which are incorporated herein by reference.

TECHNICAL FIELD

This invention generally relates to spark plugs and other ignition devices for internal combustion engines and, in particular, to electrode materials for spark plugs.

BACKGROUND

Spark plugs can be used to initiate a combustion process in an internal combustion engine. Spark plugs typically ignite a gas, such as an air/fuel mixture, in an engine cylinder or combustion chamber by producing a spark across a spark gap defined between two or more electrodes. Ignition of the gas by the spark causes a combustion reaction in the engine cylinder that is responsible for the power stroke of the engine. The high temperatures, high electrical voltages, rapid repetition of combustion reactions, and the presence of corrosive materials in the combustion gases can create a harsh environment in which the spark plug must function. This harsh environment can contribute to erosion and corrosion of the electrodes that can negatively affect the performance of the spark plug over time, potentially leading to a misfire or some other undesirable condition.

For example, nickel (Ni) and Ni-based alloys, including nickel-iron-chromium alloys like those specified under UNS N06600 and sold under the trade names Inconel 600™, Nicrofer 7615™, and Ferrochronin 600™, are widely used as spark plug electrode materials. However, these materials are susceptible to high temperature oxidation and other degradation phenomena which can result in erosion and corrosion of the electrodes, thus increasing the spark gap between the central electrode and ground electrode. The increased spark gap between the electrodes may eventually induce a misfire of the spark plug.

To reduce erosion and corrosion of the spark plug electrodes, various types of precious metals and their alloys—such as those made from platinum and iridium—have been used. These materials, however, can be costly. Thus, spark plug manufacturers sometimes attempt to minimize the amount of precious metals used with an electrode by using such materials only at a firing tip or spark portion of the electrodes where a spark jumps across a spark gap.

SUMMARY

According to one embodiment, a spark plug is provided that may include a metallic shell having an axial bore, an insulator having an axial bore and being at least partially disposed within the axial bore of the metallic shell, a center electrode being at least partially disposed within the axial bore of the insulator, and a ground electrode being attached to a free end of the metallic shell. The center electrode, the ground electrode or both includes a nickel-based volume-stable alloy including nickel (Ni), aluminum (Al), and a preformed $Ni_3Al$ phase.

According to another embodiment, a method of making a center electrode or a ground electrode for a spark plug is provided that includes the steps of: (a) providing a Ni-based alloy that includes nickel (Ni) and aluminum (Al), (b) heating the Ni-based alloy and causing a $Ni_3Al$ phase to form in the Ni-based alloy, and (c) forming at least a portion of the center electrode or the ground electrode from the Ni-based alloy. The $Ni_3Al$ phase is formed in the Ni-based alloy before the center electrode or the ground electrode is exposed to a high temperature environment of a combustion chamber in an internal combustion engine.

BRIEF DESCRIPTION OF THE DRAWINGS

Preferred exemplary embodiments of the invention will hereinafter be described in conjunction with the appended drawings, wherein like designations denote like elements, and wherein.

DETAILED DESCRIPTION OF THE PREFERRED EMBODIMENTS

Figure 1:
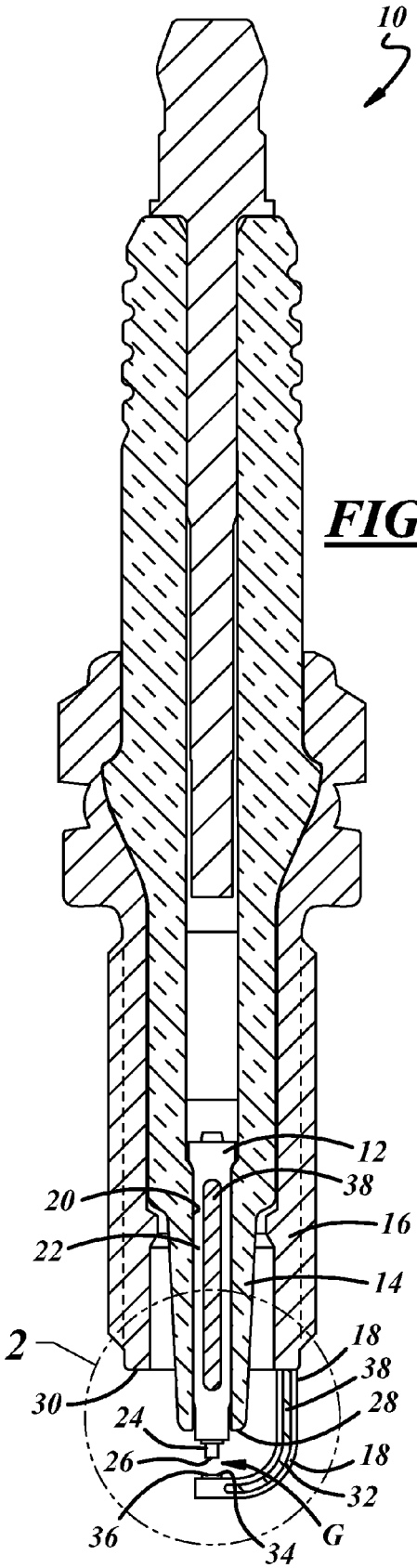
FIG. 1 is a cross-sectional view of an exemplary spark plug that may use the electrode material described below.

The electrode material described herein may be used in spark plugs and other ignition devices including industrial plugs, aviation igniters, glow plugs, or any other device that is used to ignite an air/fuel mixture in an engine. This includes, but is certainly not limited to, the exemplary spark plugs that are shown in the drawings and that are described below. Furthermore, it should be appreciated that the electrode material may be used in a firing tip that is attached to a center and/or ground electrode or it may be used in the actual center and/or ground electrode itself, to cite several possibilities. Other embodiments and applications of the electrode material are also possible.

Figure 2:
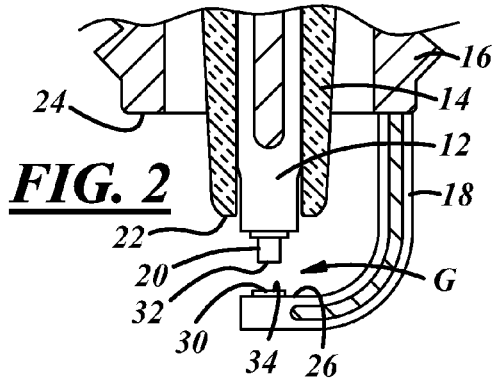
FIG. 2 is an enlarged view of the firing end of the exemplary spark plug from FIG. 1, wherein a center electrode has a firing tip in the form of a single-piece rivet and a ground electrode has a firing tip in the form of a flat pad.

Referring to FIGS. 1 and 2, there is shown an exemplary spark plug 10 that includes a center electrode 12, an insulator 14, a metallic shell 16, and a ground electrode 18. The center electrode or base electrode member 12 is disposed within an axial bore of the insulator 14 and includes a firing tip 20 that protrudes beyond a free end 22 of the insulator 14. The firing tip 20 is a single-piece rivet that includes a sparking surface 32 and is made from an erosion- and/or corrosion-resistant material, like the electrode material described below. In this particular embodiment, the single-piece rivet has a stepped shape that includes a diametrically-enlarged head section and a diametrically-reduced cylindrical stem section. The firing tip 20 may be welded, bonded, or otherwise securely attached to center electrode 12. Insulator 14 is disposed within an axial bore of the metallic shell 16 and is constructed from a material, such as a ceramic material, that is sufficient to electrically insulate the center electrode 12 from the metallic shell 16. The free end 22 of the insulator 14 may protrude beyond a free end 24 of the metallic shell 16, as shown, or it may be retracted within the metallic shell 16. The ground electrode or base electrode member 18 may be constructed according to the conventional L-shape configuration shown in the drawings or according to some other arrangement, and is attached to the free end 24 of the metallic shell 16. According to this particular embodiment, the ground electrode 18 includes a side surface 26 that opposes the firing tip 20 of the center electrode and has a firing tip 30 attached thereto. The firing tip 30 is in the form of a flat pad and includes a sparking surface 34 defining a spark gap G with the center electrode firing tip 20 such that they provide sparking surfaces 32, 34 for the emission and reception of electrons across the spark gap. Center and ground electrodes 12, 18 may typically be constructed from Ni or a solid Ni alloy. Either or both of the electrodes 12, 18 may include a core 36 of a material having a high thermal conductivity, such as copper, to help conduct heat away from the firing tip locations.

Figure 3:
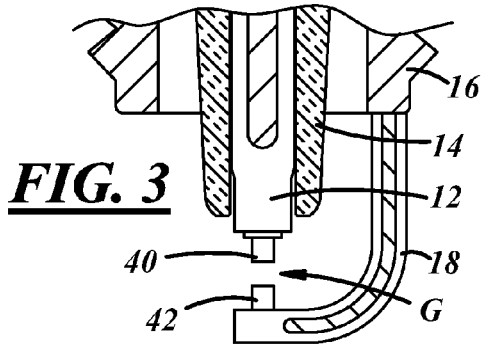
FIG. 3 is an enlarged view of a firing end of another exemplary spark plug that may use the electrode material described below, wherein the center electrode has a firing tip in the form of a single-piece rivet and the ground electrode has a firing tip in the form of a cylindrical tip.
Figure 4:
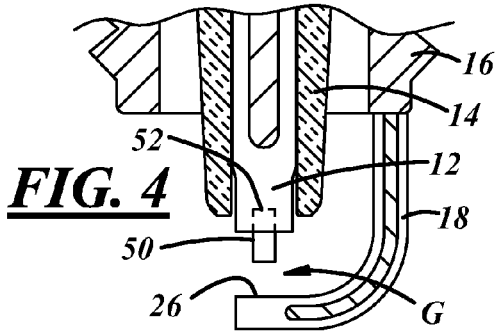
FIG. 4 is an enlarged view of a firing end of another exemplary spark plug that may use the electrode material described below, wherein the center electrode has a firing tip in the form of a cylindrical tip located in a recess and the ground electrode has no firing tip.
Figure 5:
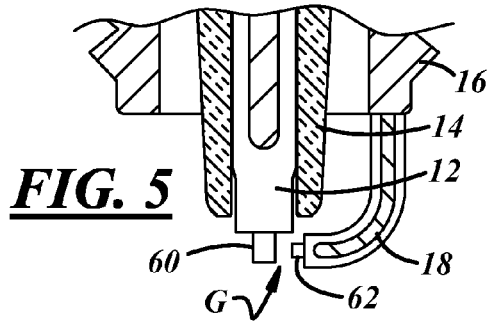
FIG. 5 is an enlarged view of a firing end of another exemplary spark plug that may use the electrode material described below, wherein the center electrode has a firing tip in the form of a cylindrical tip and the ground electrode has a firing tip in the form of a cylindrical tip that extends from an axial end of the ground electrode.

In this particular embodiment, the center electrode firing tip 20 and/or the ground electrode firing tip 30 may be made from the electrode material described herein; however, these are not the only applications for the electrode material. For instance, as shown in FIG. 3, the exemplary center electrode firing tip 40 and/or the ground electrode firing tip 42 may also be made from the electrode material. In this case, the center electrode firing tip 40 is a single-piece rivet and the ground electrode firing tip 42 is a cylindrical tip that extends away from a side surface 26 of the ground electrode by a considerable distance. The electrode material may also be used to form the exemplary center electrode firing tip 50 and/or the ground electrode 18 that is shown in FIG. 4. In this example, the center electrode firing tip 50 is a cylindrical component that is located in a recess or blind hole 52, which is formed in the axial end of the center electrode 12. The spark gap G is formed between a sparking surface of the center electrode firing tip 50 and a side surface 26 of the ground electrode 18, which also acts as a sparking surface. FIG. 5 shows yet another possible application for the electrode material, where a cylindrical firing tip 60 is attached to an axial end of the center electrode 12 and a cylindrical firing tip 62 is attached to an axial end of the ground electrode 18. The ground electrode firing tip 62 forms a spark gap G with a side surface of the center electrode firing tip 60, and is thus a somewhat different firing end configuration than the other exemplary spark plugs shown in the drawings.

Again, it should be appreciated that the non-limiting spark plug embodiments described above are only examples of some of the potential uses for the electrode material, as it may be used or employed in any firing tip, electrode, spark surface or other firing end component that is used in the ignition of an air/fuel mixture in an engine. For instance, the following components may be formed from the electrode material: center and/or ground electrodes; center and/or ground electrode firing tips that are in the shape of rivets, cylinders, bars, columns, wires, balls, mounds, cones, flat pads, disks, rings, sleeves, etc.; center and/or ground electrode firing tips that are attached directly to an electrode or indirectly to an electrode via one or more intermediate, intervening or stress-releasing layers; center and/or ground electrode firing tips that are located within a recess of an electrode, embedded into a surface of an electrode, or are located on an outside of an electrode such as a sleeve or other annular component; or spark plugs having multiple ground electrodes, multiple spark gaps or semi-creeping type spark gaps. These are but a few examples of the possible applications of the electrode material, others exist as well. As used herein, the term "electrode"—whether pertaining to a center electrode, a ground electrode, a spark plug electrode, etc.—may include a base electrode member by itself, a firing tip by itself, or a combination of a base electrode member and one or more firing tips attached thereto, to cite several possibilities.

Figure 6:
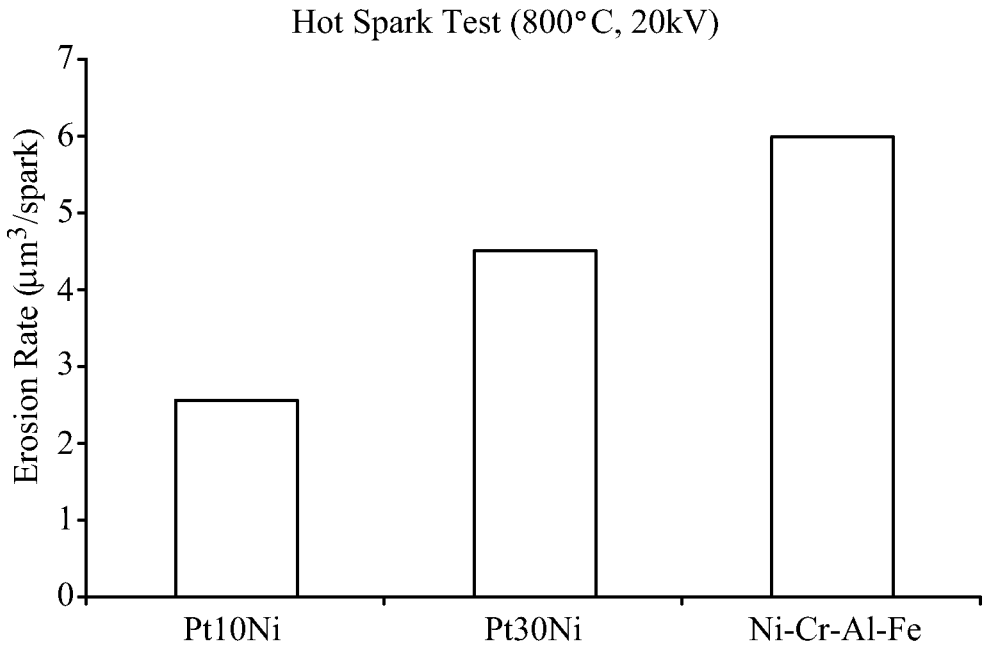
FIG. 6 is a bar chart comparing the erosion rates of precious metal alloys to the erosion rate of an exemplary volume-stable alloy.

High temperature performance alloys, also known as superalloys, including elements such as nickel (Ni), cobalt (Co), chromium (Cr), iron (Fe), and aluminum (Al) may be used in spark plug electrodes. Such alloys have high oxidation and corrosion resistance, which is ideal for spark plug electrodes. However, until now, the use of such high temperature performance alloys for spark plug electrodes and/or firing tips has been limited because these types of alloys may undergo a volume decrease during operation of the spark plug in the high temperature environment of internal combustion engines. Such a volume decrease may cause an increase in the spark gap between the spark surfaces over time, which can hinder the performance of the spark plug. As described below, the inventors of the subject matter disclosed herein have discovered the cause of the volumetric decrease and have developed techniques for making certain Ni-based alloys that are volume-stable along with spark plugs that use these volume-stable alloys to help alleviate spark gap growth during operation in a high temperature environment. Such alloys may provide high erosion and corrosion resistance without the need to rely on costly precious metal alloys. For example, as shown in FIG. 6, the volumetric erosion per spark cycle of an exemplary Ni—Cr—Al—Fe alloy is shown to be comparable to that of more expensive precious metal alloys, such as the platinum-nickel alloys of FIG. 6.

The volume-stable alloys described below are Ni-based alloys, making them compatible with typical spark plug materials previously described. More particularly, they are aluminum-containing Ni-alloys that include a $Ni_3Al$ precipitate as a γ'-phase. Additionally, Cr and/or Fe may be included in the volume-stable alloy, as will be further described below, along with other optional constituents. For example, Co may be included in the volume-stable alloys, in potential replacement of a portion of the Ni. The volume-stable alloy comprises Ni or a combination of Ni and Co to provide a Ni or Ni—Co matrix (γ) in the volume-stable alloy. In one embodiment, the volume-stable alloy includes, in weight percent (wt %) of the alloy: Ni, or a combination of Ni and Co, in an amount of at least about 65.0 wt %; Cr in an amount of about 12.0 wt % to about 20.0 wt %; Fe in an amount of about 1.5 wt % to about wt 15.0%; Al in an amount of about 4.0 wt % to about 8.0 wt %. The volume-stable alloys include at least two phases, including a solid solution Ni phase and $Ni_3Al$ precipitates. The weight percent (wt %) of a component is defined as the concentration of the component in the volume-stable alloy. For example, if the volume-stable alloy includes Fe in an amount of 1.5 wt %, then 1.5% of the total volume-stable alloy consists of Fe, and the remaining 98.5% of the total volume-stable alloy consists of other constituents. The presence and amount of the Ni, Co, Cr, Fe, Al, and other elements, components, precipitates, and features of the volume-stable alloy may be detected by a chemical analysis, or by viewing an Energy Dispersive Spectra (E.D.S.) of the material of the firing tip. The E.D.S. may be generated by a Scanning Electron Microscopy (S.E.M.) instrument.

The thermal conductivity of pure Ni or Ni alloys that may be used in each of the center and ground electrodes is preferably greater than about 20.0 W/m-K. Table I lists the composition and thermal conductivity of pure Ni and other Ni alloys compared to one embodiment of the volume-stable alloy disclosed herein.

TABLE I

| Material | Thermal Conductivity @ Room Temp. (W/m-K) |
|---|---|
| Pure Ni | 85 |
| Ni 125 (alloy A) | 36.8 |
| Ni 522 (alloy B) | 26.3 |
| Volume-stable Alloy (Ni—Cr—Al—Fe) | ~12.0 |

As shown in Table I, the thermal conductivity of the volume-stable alloy is low compared to the pure Ni and the dilute Ni alloys A and B. Also, the overall workability in manufacturing processes of the volume-stable alloy may not be as good as the pure Ni or the dilute Ni alloys. Being a highly-alloyed material, the volume-stable alloy may experience work hardening as it undergoes various processes that induce tangled dislocations, making it more difficult to work with thereafter due to brittleness and/or the material being close to its strain limit. Based on the above considerations, pure Ni or a dilute Ni alloys, such as exemplary alloy A or B, may be preferred for use in the electrodes. Because of their higher thermal conductivity, use of the pure Ni or a dilute Ni alloy as the electrode material also helps to reduce the operating temperature of the spark plug electrodes. Depending on the operating conditions and other requirements of the electrodes, the conductive core may be included in one or both electrodes to further reduce the operating temperature thereof. However, the conductive core is not required.

The volume-stable alloy includes nickel (Ni) in an amount sufficient to affect the strength of the alloy. Nickel may be the main constituent of the volume-stable alloy and is a common material for use in spark plug electrodes, as previously mentioned, due to its oxidation, corrosion, and erosion resistance, combined with the fact that it is relatively inexpensive when compared to materials such as precious metals. In one embodiment, the volume-stable alloy includes Ni in an amount of at least about 65.0 wt %. In a preferred composition, Ni may be present in an amount of about 75% wt %. In another embodiment, the volume-stable alloy includes the Ni in an amount of at least about 68.0 wt %. In another embodiment, the volume-stable alloy includes the Ni in an amount of at least about 75.0 wt %. In yet another embodiment, the volume-stable alloy includes the Ni in an amount of at least about 80.0 wt %. In another embodiment, the volume-stable alloy includes the Ni in an amount of less than about 82.6 wt %. In yet another embodiment, the volume-stable alloy includes the Ni in an amount of less than about 79.0 wt %. In another embodiment, the volume-stable alloy includes the Ni in an amount of less than about 76.0 wt %. Typically, the exact amount of nickel in the volume-stable alloy is determined by rounding out the balance of the composition with nickel after the amount of other alloy constituents are determined, where the other alloy constituents are primarily included to provide certain enhanced properties to the alloy when compared with pure Ni.

Cobalt (Co) may partially replace up to about 20.0 wt % of the Ni content of the volume-stable alloy, so that the total amount of Ni and Co is less than about 82.6 wt %. Cobalt may provide the same types of desirable properties as Ni, except that cobalt is generally a more costly material. During the mining process for Ni, it is not uncommon for Co impurities to be present, so some less pure versions of Ni may be available that include Co as a constituent. In one embodiment, the volume-stable alloy includes Co in an amount of at least about 0.5 wt %. In another embodiment, the volume-stable alloy includes the Co in an amount of at least about 4.0 wt %. In yet another embodiment, the volume-stable alloy includes the Co in an amount of at least about 6.0 wt %. In another embodiment, the volume-stable alloy includes the Co in an amount of at least about 10.0 wt %. In another embodiment, the alloy includes the Co in an amount of less than about 19.5 wt %. In yet another embodiment, alloy includes the Co in an amount of less than about 20.0 wt %. In another embodiment, the alloy includes the Co in an amount of less than about 15.0 wt %. For example, the volume-stable alloy may include Ni in an amount of about 70.0 wt % and Co in an amount of about 9.0 wt % so that the total amount of Ni and Co is about 79.0 wt %. Cobalt is not a required constituent of the volume-stable alloy, but when it is included a preferred amount may be about 1.0 wt %.

The volume-stable alloy includes chromium (Cr) in an amount sufficient to affect the strength of the volume-stable alloy. Cr may be included in the alloy for its ability to form a resilient oxide layer than can protect underlying layers from further oxidation. In one embodiment, the alloy includes the Cr in an amount of about 12.0 wt % to about 20.0 wt %, or preferably about 15.0 wt % to about 16.0 wt %. In another embodiment, the alloy includes the Cr in an amount of at least about 12.0 wt %. In another embodiment, the alloy includes the Cr in an amount of at least about 13.0 wt %. In yet another embodiment, the alloy includes the Cr in an amount of at least about 16.0 wt %. In another embodiment, the alloy includes the Cr in an amount of less than about 20.0 wt %. In yet another embodiment, the alloy includes the Cr in an amount of less than about 19.0 wt %. In another embodiment, the alloy includes the Cr in an amount of less than about 16.0 wt %. It is notable that the Ni-based alloy can be a volume-stable alloy without Cr being included as a constituent.

The volume-stable alloy includes aluminum (Al) in an amount sufficient to affect the oxidation performance of the alloy. For example, as will be further described below, Al may form an $Al_2O_3$ oxide layer on the firing tips of the spark plug that helps shield the underlying alloy from further oxidation. As previously mentioned and further described below, Al also forms a $Ni_3Al$ precipitate as a γ'-phase, which when controllably formed during production of the alloy prior to using it to fabricate spark plug electrodes or firing tips, imparts volume-stability to the alloy. In one embodiment, the alloy includes the Al in an amount of about 4.0 wt % to about 8.0 wt %. In a preferred composition, Al may be present in an amount of about 4.5 wt %. In another embodiment, the alloy includes the Al in an amount of at least about 4.0 wt %. In another embodiment, the alloy includes the Al in an amount of at least about 4.6 wt %. In yet another embodiment, the alloy includes the Al in an amount of at least about 5.9 wt %. In another embodiment, the alloy includes the Al in an amount less than about 8.0 wt %. In yet another embodiment, the alloy includes the Al in an amount less than about 7.7 wt %. In another embodiment, the alloy includes the Al in an amount less than about 5.0 wt %.

The volume-stable alloy includes iron (Fe) in an amount sufficient to affect the strength of the volume-stable alloy. Fe is also a relatively inexpensive material compared to materials such as precious metals, and even compared to Ni and can serve to help stabilize the various phases that may be present in the alloy. In one embodiment, the alloy includes the Fe in an amount of about 1.5 wt % to about wt 15.0%, preferably in an amount of about 3.0 wt % to about 5.0 wt %. In a preferred composition, Fe may be present in an amount of about 3.0 wt %. In another embodiment, the alloy includes the Fe in an amount of at least about 2.7 wt %. In another embodiment, the alloy includes the Fe in an amount of at least about 5.5 wt %. In yet another embodiment, the alloy includes the Fe in an amount of at least about 8.0 wt %. In another embodiment, the volume-stable alloy includes the Fe in an amount less than about 15.0%. In yet another embodiment, the alloy includes the Fe in an amount less than about 12.0 wt %. In another embodiment, the alloy includes the Fe in an amount less than about 6.0 wt %.

The volume-stable alloy also includes a $Ni_3Al$ precipitate. The alloy may be highly saturated, which can cause the alloy to include a $Ni_3Al$ phase (γ'). The $Ni_3Al$ phase (γ') precipitates out of the Ni matrix (γ) of an aluminum-containing Ni-based alloy at temperatures of at least about 600° C. The volume of the alloy is reduced during the formation of the $Ni_3Al$ precipitate. According to the exemplary methods outline below, the $Ni_3Al$ precipitate may be formed in the alloy prior to use of the alloy in high temperature applications, such as the internal combustion engine, thereby limiting or helping to prevent the formation of the $Ni_3Al$ precipitate and the associated volume decrease and spark gap increase, during use of the spark plug. Specifically, the amount of volume reduction limited or prevented during use of the spark plug in high temperature applications is typically about equal to the volume reduction that occurs during pre-formation of the $Ni_3Al$ precipitate. In other words, the alloy has a stable volume, including little or no change, during use of the spark plug in the internal combustion engine.

During the formation of the $Ni_3Al$ precipitate, a majority of the Ni matrix (γ) may transform into the $Ni_3Al$ precipitate (γ'). The volume reduction occurs because the $Ni_3Al$ precipitate (γ') is denser and has a smaller lattice parameter than the Ni matrix (γ). The lattice misfit of the $Ni_3Al$ precipitate (γ') and Ni matrix (γ) in the alloy is from about −0.1 to about −0.5%. The volume fraction of the $Ni_3Al$ precipitate (γ') in the alloy can range from about 20% up to about 70.0%. For example, in alloys that include Al in an amount more than about 6.0 wt %, the volume fraction of the γ'-phase may be about 60-70%. In alloys that include Al in an amount less than about 4.0 wt %, the volume fraction of the γ'-phase may be about 20-30%. Thus, the formation of the $Ni_3Al$ precipitate (γ') increases the density of the alloy, which reduces the volume of alloy. The transformation of the Ni matrix (γ) to the $Ni_3Al$ precipitate (γ') prior to use of the spark plug in high temperature applications avoids the volume shrinkage and increasing the spark gap during use of the spark plug in the high temperature applications.

Figure 7:
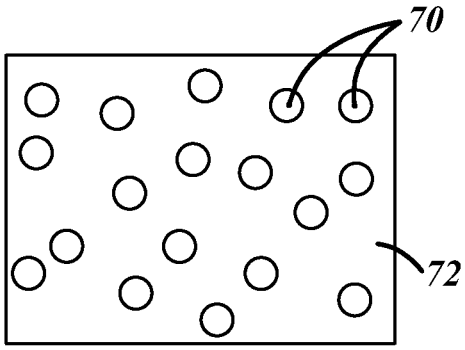
FIG. 7 is a schematic representation of a $Ni_3Al$ precipitate dispersed in a Ni matrix, the precipitate having sphere-shaped regions.
Figure 8:
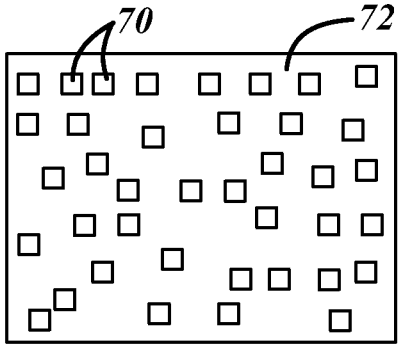
FIG. 8 is a schematic representation of a $Ni_3Al$ precipitate dispersed in a Ni matrix, the precipitate having cube-shaped regions.

Referring to FIGS. 7 and 8, the γ'-phase 70 may be dispersed in the Ni or Ni—Co matrix 72. Depending on the volume fraction of the γ'-phase, it may also be present in different morphologies. For example, as shown in FIG. 7, at lower volume fractions such as 20-30%, the γ'-phase regions 70 of the alloy assume a structure that is sphere-like or that have generally rounded shapes. As shown in FIG. 8, at higher volume fractions such as 60-70%, the γ'-phase regions of the alloy assume a structure that is cube-like or that have generally sharp edges. There may also be a mixture of the two morphologies. That is to say that some γ'-phase regions of the alloy may be spherical, while other regions may be cubic where the volume fraction of the $Ni_3Al$ precipitate phase falls between 30% and 60%. On average, the individual particles or regions of the $Ni_3Al$ phases may range from about 0.2 μm to about 4 μm. FIGS. 7 and 8 are schematic depictions only, simplified for explanatory purposes, and are not to scale or meant to indicate any specific volume fractions or relative phase sizes or distributions.

The volume-stable alloy may also include manganese (Mn) in an amount less than about 1.0 wt %; silicon (Si) in an amount less than about 1.0 wt %; carbon (C) in an amount less than about 0.1 wt %; boron (B) in an amount less than about 0.03 wt %; and zirconium (Zr) in an amount less than about 0.5 wt %. However, Mn, Si, C, B, and Zr are not required constituents.

The volume-stable alloy may also include yttrium (Y), lanthanum (La), or hafnium (Hf) in an amount sufficient to substantially affect the adherence of the $Al_2O_3$ layer formed at the sparking surface to the adjacent portion or bulk of the firing tip. In one embodiment, the alloy includes the Y in an amount less than about 1.0 wt %. In another embodiment, the alloy includes the Y in an amount greater than about 0.001 wt %. In yet another embodiment, the alloy includes the La in an amount less than about 1.0 wt %. In another embodiment, the alloy includes the La in an amount greater than about 0.001 wt %. In another embodiment, the alloy includes the Hf in an amount less than about 1.0 wt %. In yet another embodiment, the alloy includes the Hf in an amount greater than about 0.001 wt %.

At high temperatures, each electrode or firing tip comprising the volume-stable alloy typically forms an aluminum oxide ($Al_2O_3$) layer at its outer surface, including the sparking surfaces of the firing tips, for example. The $Al_2O_3$ layer is typically formed when the volume-stable alloy is heated to a temperature greater than about 600° C., such as during use of the spark plug in an internal combustion engine. When the sparking surfaces comprise a planar surface, the $Al_2O_3$ layer typically extends along the planar surface. Thus, the firing tips may comprise a gradient material composition, wherein the sparking surface includes a layer of $Al_2O_3$ and the adjacent portion or bulk of the firing tip comprises another composition including the Ni, Cr, Fe, and Al, for example. Prior to exposing the volume-stable alloy to high temperatures, the $Al_2O_3$ layer is not present, and the firing tips typically comprise a uniform material composition. Once the $Al_2O_3$ layer forms at the outer surface or sparking surface, it typically remains there at all temperatures. Such an $Al_2O_3$ layer is dense, stable, and has low formation free energy. Thus, the $Al_2O_3$ layer may provide improved oxidation resistance to protect the firing tips from erosion and corrosion when the spark plug electrodes are exposed to sparks and the extreme conditions of the combustion chamber.

Firing tips or electrodes including the volume-stable alloy thus described may provide excellent oxidation and corrosion resistance and perform well at the high temperatures and in the harsh conditions of the internal combustion engine. In a preferred composition, the volume-stable alloy may include the following: Ni (75.0 wt %), Cr (16.0 wt %), Al (4.5 wt %), Fe (3.0 wt %), Mn (0.5 wt % or less), and Si (0.2 wt % or less), where at least some of the Ni and Al is present in a pre-formed $Ni_3Al$ precipitate in a γ'-phase.

A method of fabricating a spark plug, such as that depicted in FIG. 1, that includes the volume-stable alloy may also be described, where the spark plug includes at least one electrode including the volume-stable alloy. The method comprises the steps of: providing an alloy including Ni, or a combination of Ni and Co, Cr, Fe, and Al; heating the alloy to a first temperature of about 1000° C. to about 1350° C.; quenching the alloy; heating the alloy to a second temperature of about 550° C. to about 950° C.; and maintaining the alloy at the second temperature until a $Ni_3Al$ precipitate forms in the alloy. The method of fabricating the spark plug, including the heating and cooling, is performed prior to using the spark plug in high temperature applications, such as the internal combustion engine.

The volume-stable alloy is typically provided by mixing Ni, or a combination of Ni and Co, in an amount of at least about 65.0 wt %; Cr in an amount of about 12.0 wt % to about 20.0 wt %; Al in an amount of about 4.0 wt % to about 8.0 wt %; and Fe in an amount of about 1.5 wt % to about 15.0 wt % to form a Ni-based mixture. The Ni, Co, Cr, Fe, Al, and other components used to form the volume-stable alloy may be in the form of powder metal or in other solid form.

The step of providing the alloy may include sintering a nickel-based powder metal mixture. The sintering temperature is not specified, but it is a temperature capable of sintering a Ni-based powder metal mixture to form an alloy. Other metallurgy processes, such as various melting processes followed by casting and extrusion processes, may be used to form the alloy, instead of sintering. Melt processing using induction heat or other types of heat sources to melt powder or other solid forms of the constituents may be used to accomplish the step of providing the alloy.

As stated above, the method includes heating the alloy to a first temperature of about 1000° C. to about 1350° C. and preferably about 1200° C. to 1300° C. The first temperature depends on the composition of the alloy. The method also includes maintaining the alloy at the first temperature until the Co, Cr, Fe, Al, and other elements of the alloy are dissolved in the Ni matrix of the alloy. This heating step may be referred to as a solution treatment.

After the solution treatment, the method includes cooling the alloy to form a super-saturated Ni solid solution. The temperature of the alloy is typically reduced to about ambient temperature or room temperature, for example about 10° C. to about 40° C. The cooling step may be referred to as quenching. The quenching medium may be air or water at 10-40° C. circulated about the alloy during cooling. The cooling step may be conducted in a short amount of time, such as about 1 minute or less, but the time may vary depending on the first temperature, the temperature of the cooling medium, and the mass of the alloy being cooled, to name a few factors. Preferably the alloy is cooled as quickly as possible in the range from 1200° C. down to about 800° C., after which the cooling rate may be lessened.

After the cooling step, the method further includes heating the alloy again to a second temperature of about 550° C. to about 950° C., and maintaining the alloy at the second temperature until a $Ni_3Al$ phase ($\gamma'$) precipitates within a Ni or Ni—Co ($\gamma$) matrix of the alloy, to provide the volume-stable alloy including the $Ni_3Al$ precipitate. This heating step may be referred to as an aging treatment. Typically, the alloy is maintained at the second temperature for about 30 minutes to about 180 minutes before the $Ni_3Al$ phase ($\gamma'$) precipitates. However, the amount of time depends on the composition and saturation level of the alloy. In any case, the objective of the aging treatment is to maximize the pre-formed $Ni_3Al$ content of the alloy so that, once in service in a spark plug electrode and in a high temperature environment, no further $Ni_3Al$ precipitate is formed, thereby preventing any additional volume decrease and associated spark gap increase during service.

The solution treatment, quenching, and aging treatment pre-forms the $Ni_3Al$ precipitate and causes a volume reduction or an increase in the density of the alloy, prior to its use in a spark plug in the internal combustion engine. In other words, the formation of the $Ni_3Al$ precipitate, as described above, allows the alloy to maintain a stable volume, including little or no change, during the high temperature use of the spark plug that includes the volume-stable alloy.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A spark plug, comprising:

a metallic shell having an axial bore;

an insulator having an axial bore and being at least partially disposed within the axial bore of the metallic shell;

a center electrode being at least partially disposed within the axial bore of the insulator; and a ground electrode being attached to a free end of the metallic shell;

wherein the center electrode, the ground electrode or both includes a nickel-based volume-stable alloy including nickel (Ni), aluminum (Al), and a pre-formed $Ni_3Al$ phase in an amount that does not substantially change when the volume-stable alloy is subsequently exposed to a high temperature environment of an internal combustion engine.

2. The spark plug of claim 1, wherein nickel (Ni) is present in the volume-stable alloy in an amount of at least about 65.0 wt %.

3. The spark plug of claim 1, wherein aluminum (Al) is present in the volume-stable alloy from about 4.0 wt % to about 8.0 wt %.

4. The spark plug of claim 1, wherein the volume-stable alloy further comprises chromium (Cr) from about 12.0 wt % to about 20.0 wt %.

5. The spark plug of claim 1, wherein the volume-stable alloy further comprises iron (Fe) from about 1.5 wt % to about 15.0 wt %.

6. The spark plug of claim 1, wherein the volume-stable alloy further comprises cobalt (Co) up to about 20 wt %.

7. The spark plug of claim 6, wherein the combined amount of cobalt (Co) and nickel (Ni) that is present in the volume-stable alloy is at least about 65.0 wt %.

8. The spark plug of claim 1, wherein the pre-formed $Ni_3Al$ phase is present in the volume-stable alloy from about 20% to about 70% of the overall volume of the alloy.

9. The spark plug of claim 1, wherein the pre-formed $Ni_3Al$ phase includes a $Ni_3Al$ precipitate as a γ'-phase that is dispersed within a Ni-based matrix and includes particles ranging in size from about 0.2 to about 4 μm.

10. The spark plug of claim 1, wherein the volume-stable alloy includes at least 65.0 wt % Nickel (Ni), 4.0-8.0 wt % aluminum (Al), 12-20 wt % chromium (Cr), and 1.5-15.0 wt % iron (Fe).

11. The spark plug of claim 10, wherein the volume-stable alloy further comprises at least one element selected from the group consisting of: yttrium (Y), lanthanum (La) or hafnium (Hf) up to about 1.0 wt %.

12. The spark plug of claim 10, wherein the volume-stable alloy further comprises yttrium (Y) in an amount up to about 0.01 wt %.

13. The spark plug of claim 10, wherein the volume-stable alloy further comprises at least one element selected from the group consisting of: manganese (Mn) in an amount less than about 1.0 wt %, silicon (Si) in an amount less than about 1.0 wt %, carbon (C) in an amount less than about 0.1 wt %, boron (B) in an amount less than about 0.03 wt %, or zirconium (Zr) in an amount less than about 0.5 wt %.

14. The spark plug of claim 1, wherein an electrode that includes the volume-stable alloy does not undergo any substantial decrease in volume when the electrode is exposed to a high temperature environment of a combustion chamber in an internal combustion engine.

15. The spark plug of claim 1, wherein the total amount of $Ni_3Al$ in the volume-stable alloy does not substantially increase over the amount of $Ni_3Al$ in the pre-formed $Ni_3Al$ phase when the electrode that includes the volume-stable alloy is exposed to a high temperature environment of a combustion chamber in an internal combustion engine.

16. The spark plug of claim 1, wherein the center electrode, the ground electrode or both includes an attached firing tip that is made from the volume-stable alloy.

17. The spark plug of claim 1, wherein the center electrode, the ground electrode or both is integrally formed from the volume-stable alloy such that the entire electrode is made of the volume-stable alloy.

18. A spark plug, comprising:

a metallic shell having an axial bore;

an insulator having an axial bore and being at least partially disposed within the axial bore of the metallic shell;

a center electrode being at least partially disposed within the axial bore of the insulator; and a ground electrode being attached to a free end of the metallic shell;

wherein the center electrode, the ground electrode or both includes a nickel-based volume-stable alloy including a Ni-based matrix phase and a pre-formed $Ni_3Al$ precipitate phase dispersed within the Ni-based matrix phase.

* * * * *